United States Patent [19]

Shaw

[11] Patent Number: 4,884,849

[45] Date of Patent: Dec. 5, 1989

[54] APPARATUS FOR MANUFACTURE OF END BRUSH

[75] Inventor: Richard J. Shaw, Hartland, Wis.

[73] Assignee: Better Health Concepts Co Inc., Milwaukee, Wis.

[21] Appl. No.: 283,089

[22] Filed: Dec. 12, 1988

[51] Int. Cl.[4] ..... A46D 3/04

[52] U.S. Cl. ..... 300/4; 300/5; 300/7; 300/8; 300/10; 300/21

[58] Field of Search ..... 15/180; 300/2, 5, 1, 300/7, 8, 4, 10, 21

[56] References Cited

U.S. PATENT DOCUMENTS

| | | | |
|---|---|---|---|
| 2,421,647 | 6/1947 | Peterson | 15/180 |
| 3,009,184 | 11/1961 | Dolan | 15/180 |
| 3,562,833 | 2/1971 | Charvat | 15/180 |
| 3,585,671 | 6/1971 | Schofield | 15/180 |
| 3,641,611 | 2/1972 | Schofield | 15/180 |
| 4,109,965 | 8/1978 | Lewis, Jr. | 300/7 |
| 4,408,367 | 10/1983 | Pusterhofer | 300/21 X |
| 4,733,917 | 3/1988 | Boucherie | 300/7 |
| 4,749,233 | 6/1988 | Weihrauch | 300/21 |
| 4,795,218 | 1/1989 | Seidler | 300/21 |

*Primary Examiner*—Timothy V. Eley
*Attorney, Agent, or Firm*—Robert T. Johnson

[57] ABSTRACT

This invention relates to a new and useful apparatus and method of manufacture of an end brush, comprised of thermoplastic bristles. The apparatus comprises a fiber feed guide eye for fiber skein, a fiber bundle adjustable aperture plate, electric induction heater coil surrounding a tapered splined male pin and a source of cold air blast, and the tapered splined male pin activated by a compression spring to force the heated tapered splined pin into the fiber bundle held in the adjustable aperture plate. The movement of the tapered splined male pin is limited by stops. The subsequent cooling of the tapered splined pin withdraws the fused end brush from the open adjustable aperture plate and the bristles of the end brush are severed from the skein of fibers, and the end brush attached to the tapered splined pin is subsequently knocked off of the pin by means of a hammer.

6 Claims, 4 Drawing Sheets

SECTION A-A

SECTION B-B

SECTION C-C

APPARATUS FOR MANUFACTURE OF END BRUSH

SUMMARY OF INVENTION

Disclosure is made of apparatus for manufacture of end brushes and method of such manufacture.

End brushes can be described as a bundle of brush fibers, with one end of the bundle held in a metal or plastic cup form.

To mount the bundle of brush fibers in a cup form is costly and adds weight and diameter to the bundle which is a serious disadvantage for use of such end brushes.

Disclosure is made in this invention of apparatus and method for end brush manufacture wherein plastic fibers are fused together on one end of the bundle to produce an end brush, and further the end brush so produced has a female tapered, splined cross section in the center of the end of the fused end of the brush and extending parallel to the bristle alignment, for a distance equal to the fused section of the end brush.

End brushes of this manufacture have use or utility in electric toothbrushes or can be mounted in multiple numbers to produce other types of brushes.

OBJECTS OF THIS INVENTION

An object of this invention is to disclose apparatus for manufacture of end brushes comprising feeding a hank or skein of plastic fibers such as nylon through an open adjustable aperture then closing the adjustable orifice to clamp the fiber bundle in position and positioning a spring loaded heated male tapered spline end, on to the center of the end of the fiber bundle, and held in such position to melt the fiber bundle end to allow entry into the fiber bundle of the heated male tapered spline to a preset distance, and chilled air then blown around the tapered spline to cool the fused fiber bundle end around the tapered spline, the adjustable aperture is placed in open position and the cooled tapered spline with fused end fiber bundle attached thereto is pulled downward a preset distance, the fiber bundle is then cut and the end brush attached to the male spline is stripped off of the male spline by withdrawal of the male tapered spline into a sleeve surrounding the male tapered spline.

Another object of this invention is to disclose as an article of manufacture an end brush of thermoplastic fibers, and the fibers heat fused on one end into a bundle around a splined center hole in the fused fiber end.

Another object of this invention is to disclose a method of manufacture of an end brush bundle of thermoplastic fibers and the fibers are heat fused into a bundle on one end of the bundle around a center hole in the fused fiber end and the center hole provided by means of a heated splined male pin melting the fiber bundle and the heated splined male pin driven into the softened or melted fiber bundle base, and cooling the heated splined male pin and melted fiber bundle base to congeal and fuse the thermoplastic fiber bundle to form a base on the end brush.

Another object of this invention is to disclose a male spline pin heated by means of an electric induction coil surrounding the male spline pin and the heating of the splined pin controlled by a heating time cycle to allow the splined pin to be forced into the thermoplastic fiber bundle base.

Other objects of this invention will be apparent in the following disclosure and claims.

RELATED PRIOR ART

U.S. Pat. No. 2,421,647 for End Brush.

Disclosure is made in this patent of an end brush wherein the bristles are held in a cup shaped base.

U.S. Pat. No. 3,142,854 for Rotary Brush.

Disclosure is made in this patent of U shape fiber bundles.

U.S. Pat. No. 3,562,833 for Rotary Brush.

This patent discloses bristles held in a cup.

U.S. Pat. No. 3,585,671 for Rotary Brush.

This patent discloses bristles held in a cup and O ring crimped in the cup.

U.S. Pat. No. 3,641,611 for Brush Construction.

Disclosure is made in this patent of bristle bundles held in a corrugated metal band.

U.S. Pat. No. 4,109,965 for Picking Device.

Disclosure is made in this patent for dispensing cut-to-length synthetic filaments and fusing one end of the filaments.

None of the above reference patents singly or collectively disclose this present invention, as herein disclosed and claimed.

DETAILED DESCRIPTION OF DRAWINGS

Figure 1:
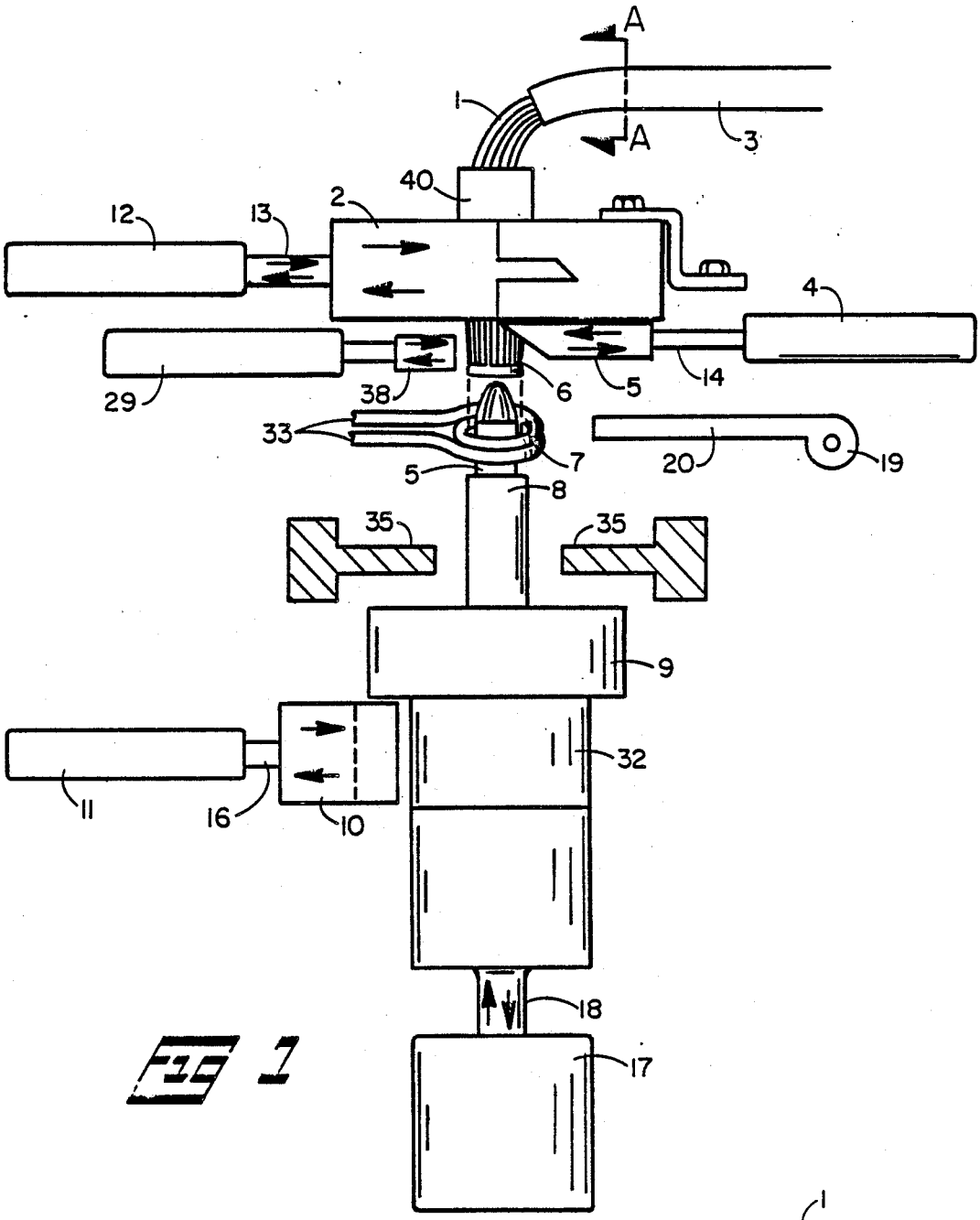
FIG. 1—Assembled apparatus for manufacture of end brush.
Figure 2:
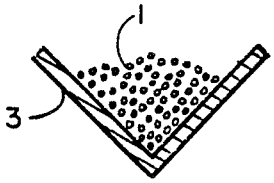
FIG. 2—Cross section view AA of fiber bundle feed trough and fiber hank or skein.
Figure 4:
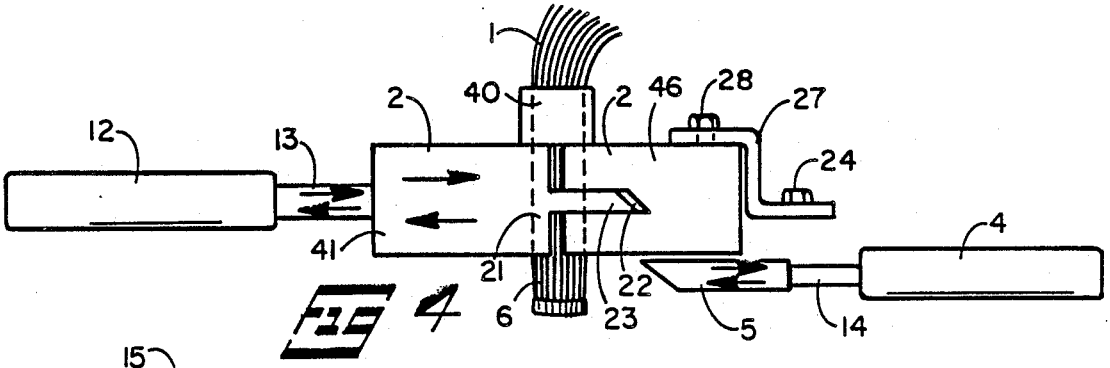
FIG. 4—Isolated detail of relation of fiber bundle adjustable aperture and fiber bundle cutter blade.
Figure 6:
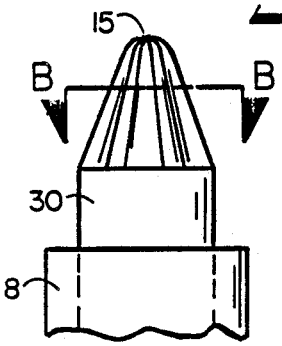
FIG. 6—Enlarged elevation view of splined head and shaft in sleeve mount.
Figure 7:
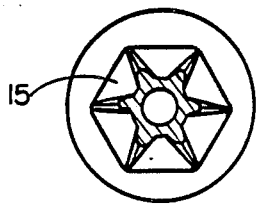
FIG. 7—Section view of splined head.
Figure 9:
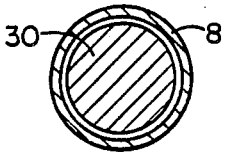
FIG. 9—Section C—C of FIG. 8, showing splined head shaft fitting in sleeve guide.
Figure 5:
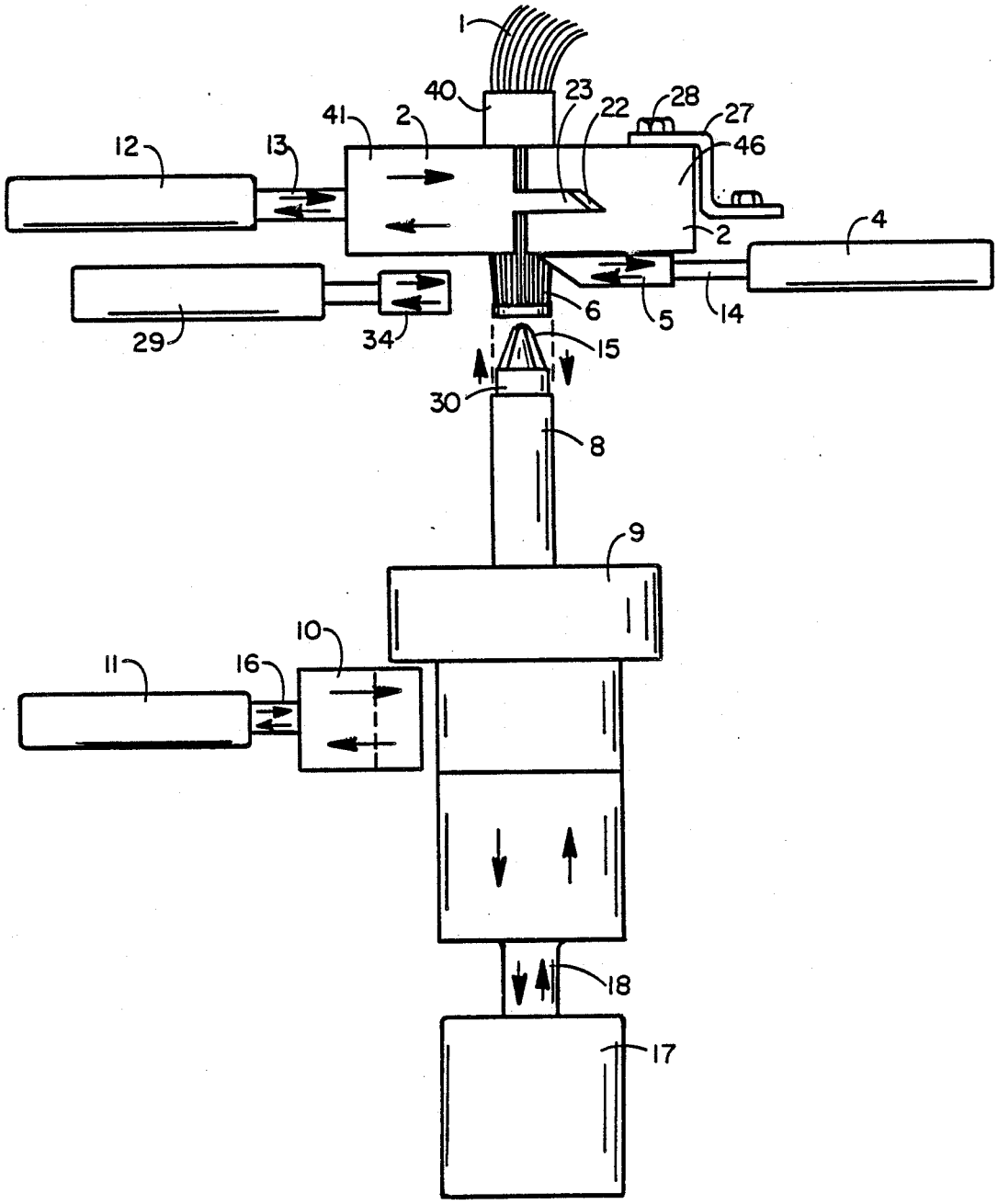
FIG. 5—Isolated detail relation of fiber bundle adjustable aperture, cut off knife, spline pin head and stop plate.
Figure 8:
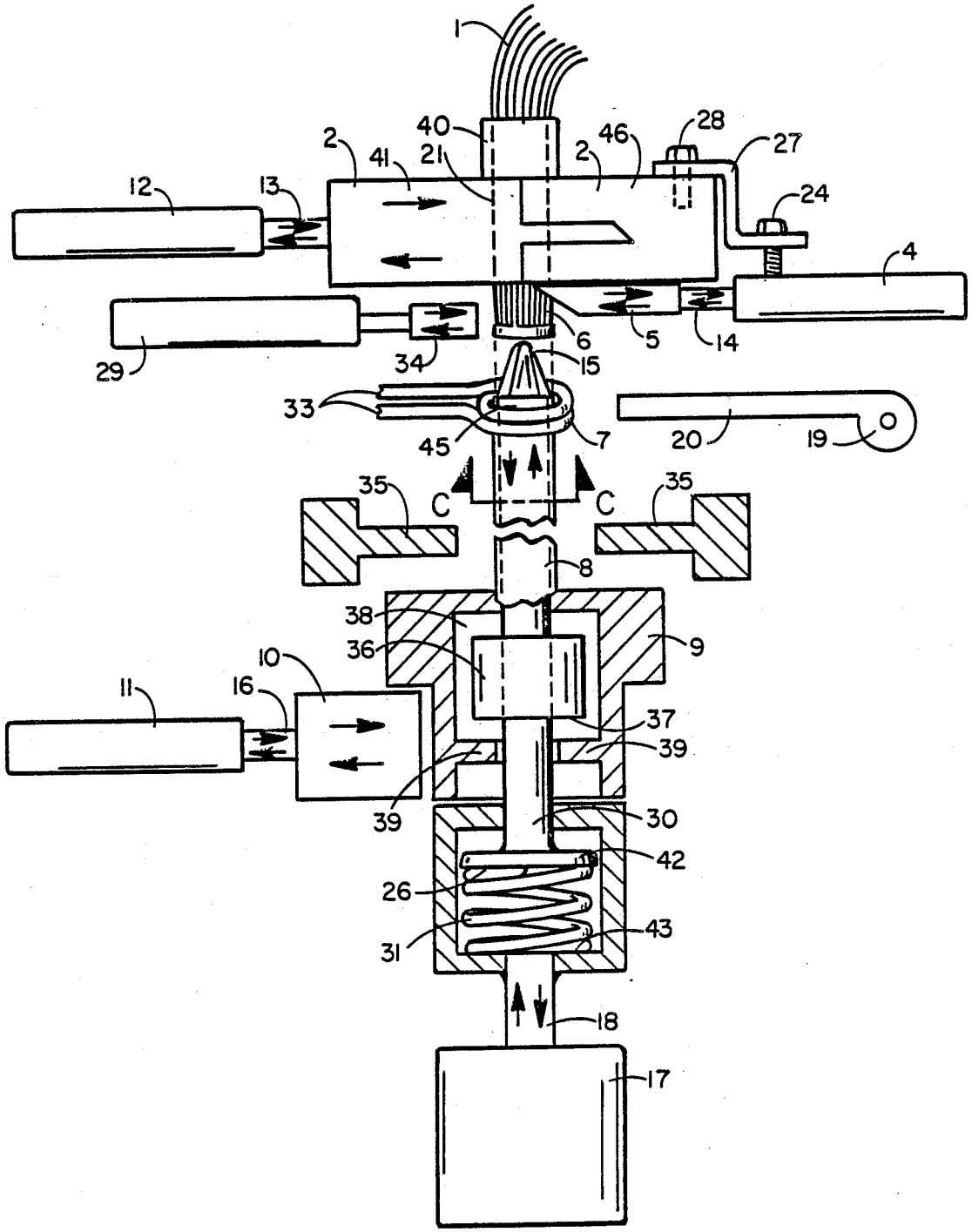
FIG. 8—Detailed elevation cut away view of end brush manufacture apparatus.

FIG. 1—Assembled apparatus for manufacture of end brush wherein:

1—Fiber hank or skein
2—Fiber bundle adjustable aperture
3—Fiber hank or skein feed trough
4—Fluid powered cylinder for cut off blade
5—Fiber bundle cutter blade
6—Fiber bundle
7—Induction heater coil
8—Spline pin guide sleeve
9—Stop collar
10—Stop plate
11—Fluid powered cylinder for stop plate drive
12—Fluid powered cylinder drive for aperture closure
13—Connecting rod from fluid drive cylinder to fiber bundle adjustable aperture
14—Connecting rod from fluid drive cylinder to fiber bundle cutter blade
15—Splined male pin 16—Connecting rod from fluid drive cylinder to stop plate
17—Fluid powered cylinder
18—Connecting rod from fluid drive cylinder to spline pin guide
19—Cold air supply
20—Cold air duct.
FIG. 2—Cross section view A—A of fiber bundle feed trough and fiber hank or skein wherein:
1—Fiber hank or skein
3—Fiber hank or skein feed trough
FIG. 3
2—Fiber bundle adjustable aperture plate
21—Adjustable aperture
22—Female slot in adjustable aperture plate
23—Tongue section of aperture plate
13—Connecting rod from fluid drive cylinder to fiber bundle adjustable aperture
41—Reciprocating end of fiber bundle adjustable aperture plate
46—Stationary end of adjustable aperture plate
FIG. 4
1—Fiber hank or skein
2—Fiber bundle adjustable aperture
4—Fluid powered cylinder for cut off blade
5—Fiber bundle cutter blade
6—Fiber bundle end brush
12—Fluid powered cylinder drive for aperture closure
13—Connecting rod from fluid powered cylinder to fiber bundle adjustable aperture
21—Adjustable aperture
22—Female slot in adjustable aperture plate
23—Tongue section of aperture plate
24—Stop hold down anchor bolt
27—Hold down arm for stationary end of aperture plate
28—Anchor bolt for stop hold down arm
41—Reciprocating end of fiber bundle adjustable aperture plate
46—Stationary end of adjustable aperture plate
FIG. 5
1—Fiber hank or skein
2—Fiber bundle adjustable aperture
4—Fluid powered cylinder for cut off blade
5—Fiber bundle cutter blade
6—Fiber bundle end brush
8—Spline pin guide sleeve
9—Stop collar
10—Stop plate
11—Fluid powered cylinder for stop plate drive
12—Fluid powered cylinder drive for aperture closure
13—Connecting rod from fluid drive cylinder to fiber bundle adjustable aperture
14—Connecting rod from fluid drive cylinder to fiber bundle cutter blade
15—Splined male pin
16—Connecting rod from fluid drive cylinder to stop plate
17—Fluid powered cylinder
18—Connecting rod from fluid drive cylinder to spline pin guide.
FIG. 6
8—Spline pin shaft guide sleeve
15—Splined male pin head
FIG. 7—Section BB enlarged plan view of tapered spline pin.
15—Tapered splined male pin.
FIG. 8—Enlarged elevation cut away view of end brush manufacturing apparatus wherein:
1—Fiber hank or skein
2—Fiber bundle adjustable aperture plate
3—Fiber hank or skein feed trough
4—Fluid powered cylinder for cut off blade
5—Fiber bundle cutter blade
6—Fiber bundle end brush
7—Induction heater coil
8—Spline pin shaft guide sleeve
9—Stop collar
10—Stop plate
11—Fluid powered cylinder for stop plate drive
12—Fluid powered cylinder drive for aperture closure
13—Connecting rod from fluid drive cylinder to fiber bundle adjustable aperture
14—Connecting rod from fluid drive cylinder to fiber bundle cutter blade
15—Tapered splined male pin
16—Connecting rod from fluid drive cylinder to stop plate
17—Fluid powered cylinder
18—Connecting rod from fluid drive cylinder to housing of spring and spline pin shaft flange
19—Cold air supply
20—Cold air duct nozzle
21—Adjustable aperture
22—Female slot in aperture plate
23—Tongue section of aperture plate
24—Stop hold down anchor
25—Pin to attach collar mount to splined pin shaft
26—Spline head shaft base
27—Hold down arm
28—Anchor bolt for stop hold down arm
29—Fluid powered cylinder
30—Tapered splined male pin shaft
31—Compressed spring
32—Housing for spring and splined head shaft base
33—Leads for induction heater coil
34—Brush knock off hammer
35—Stop limits
36—Collar mount on splined head shaft
37—Collar bottom shoulder
38—Collar top shoulder
39—Lower stop rim
40—Fiber feed guide eye for fiber skein
41—Reciprocating end of fiber bundle adjustable aperture plate
42—Flanged base of splined male pin shaft
43—Inner bottom of housing for compression spring and flanged tapered splined male head shaft base
44—Upper stop of stop collar 9
46—Stationary end of fiber bundle adjustable aperture plate
FIG. 9—Section C—C of FIG. 8 wherein:
8—Spline pin guide sleeve
30—Splined head shaft
FIG. 10—Expanded elevation view of end brush attached to tapered splined male pin wherein:
6—Fiber bundle end brush
8—Splined pin shaft guide sleeve
15—Tapered splined male pin
30—Tapered splined male pin shaft
45—End brush

DETAILED DESCRIPTION OF INVENTION

The apparatus of this invention for manufacture of an end brush differs from the conventional apparatus in that the bristle bunch is cut from a hank or skein after fusing together the bristle bunch at the base of the end brush.

In the following discussion, fluid powered cylinders 4, 11, 12, 17 and 29 are attached to components for back and forth and up and down movement, as shown in FIG. 8, and movement of the components may then be described without including the cylinders noted.

Figure 3:
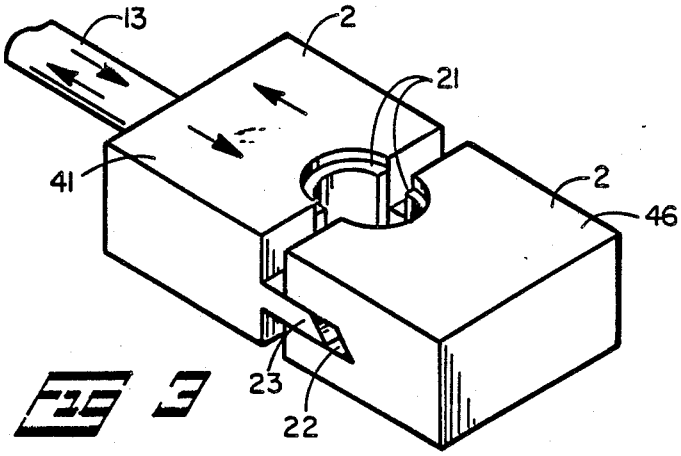
FIG. 3—Detail of fiber bundle adjustable aperture.

Referring now to FIG. 8, which shows magnified assembly of the apparatus, the skein of fiber 1 feeds through feed guide eye for fiber skein 40, and through fiber bundle aperture 21 in fiber bundle adjustable aperture plate 2, see FIG. 3. The fiber bundle adjustable aperture plate 2 (see FIGS. 3 and 4) consists of two halves fitting together, with tongue section 23 of aperture plate section 41—41 fitting in female slot 22 of stationary half 46 of the aperture plate. Fluid powered cylinder 12 is attached to connecting rod 13 in turn attached to reciprocable end 41 of fiber bundle adjustable plate 2.

The fiber bundle adjustable aperture plate 2 has as its purpose to allow the fiber bundle to pass through the adjustable aperture 21 when the cylinder 12 is retracted, and when a certain pre set length of fibers is pulled through the aperture 21, the cylinder 12 is actuated forward through connector rod 13 to hold the fiber bundle in the aperture 21 for further processing.

Stop hold down anchor 24 and anchor bolt 28 and hold down arm 27 attached to the stationary end 46 opposite the fluid powered cylinder drive 12, serves to ridigly hold the female half 46 of the aperture plate 2 when cylinder 12 is actuated.

Induction heater coil 7 with leads 33 for the induction heater coil is mounted around tapered splined male pin 15. The heater coil 7 has adequate diameter to not make contact with the tapered splined male pin 15. Cold air duct nozzle 20 is set to aim at the tapered splined male pin 15. The cold air supply 19 can be that generated by a cyclonic action in a "Vortec Tube" apparatus. This "Vortec" is a trade mark of Vortec Company of Cincinnati, Ohio.

Tapered splined male pin 15 is mounted at the top of spline head shaft 30, and this shaft 30 is enclosed in spline pin shaft guide sleeve 8, and flanged base 42 of spline head shaft 30, extends into housing for spring 31 and splined head shaft base flange 32. Compression spring 31 is mounted in housing 32 and is held in compression between flanged base 42 and bottom 43 of housing 32. A collar mount 36 on splined head shaft 30, is rigidly mounted thereon and is positioned in stop collar 9. The collar mount 36 is so mounted that collar top shoulder 38, limits upward movement of splined head shaft 30, when shoulder 38 of collar mount 36, makes contact with upper stop 44 of stop collar 9 which in turn sets the limit of extension of splined splined pin 15 beyond the top rim 45 of sleeve 8. Splined splined pin 15 extends beyond top rim 5, of sleeve 8, when splined head shaft 39 is forced upward by compression spring 31 in housing 32 for spring and splined head shaft base. The compression spring 31 acts on flanged base 42 of splined head shaft base 26.

Housing 32 for spring and splined head shaft base is attached to connecting rod 18 from fluid drive cylinder 17.

For actuation of splined head shaft 30 stop limits 35 are mounted above stop collar 9, while stop plate 10 is mounted below stop collar 9, and stop plate 10 is actuated by fluid powered cylinder for stop plate drive 11, connected to connecting rod 16 from fluid drive cylinder to the stop plate 10.

Lower stop rim 39 limits withdrawal of splined shaft 30 on contact with bottom shoulder 37 of collar mount 36 attached to splined head shaft by means of pin 25.

The fiber hank or skein 1 is laid out on feed trough 3, and fed into fiber feed guide eye 40, and through fiber bundle adjustable aperture 2. End brush knock off hammer 34, is actuated by fluid powered cylinder 29. Fiber bundle cutter blade 5 is actuated by fluid powered cylinder 4 through connecting rod 14 from fluid power cylinder to fiber bundle cutter blade 5.

The above described apparatus has not included sequencing apparatus as such is well known in manufacturing apparatus.

The sequence steps of the above apparatus to disclose the method of end brush manufacture is as follows.

The hank or skein 1, of thermoplastic fibers such as nylon is fed into the fiber feed guide eye 40, at which time the aperture 21 of aperture plate 2 is in the open position. The leading end of the fiber hank is flush with the bottom of the aperture plate and fluid cylinder 12 is actuated to close the aperture 21 to hold the fiber skein as a fiber bundle in the closed aperture 21. Tapered splined male pin 15 is brought in contact with the bottom end of the fiber bundle held in closed aperture 21, and induction heating coil 7 is actuated to heat the tapered splined male pin 15, to the melt or fusion point of the plastic fibers. The tapered splined male pin 15, is held in contact with the fiber bundle end, by means of a compression spring 31 which will force the splined pin 15 into the fiber bundle end as melting of the fibers takes place at which time the splined pin 15 makes full entry to a predetermined distance in the fiber bundle, at which time heating is discontinued and a cold air blast from source 19 through cold air duct nozzle 20 cools the fiber bundle around the splined pin 15, at which time the aperture 21 is opened, and the splined pin 15 with the fiber bundle end brush 6 attached thereto is drawn downward by action of cylinder 17 a predetermined distance, and fiber bundle cutter blade 5 is actuated by cylinder 4 to cut the fiber bundle from the skein. After cutting, the fused fiber bundle end brush 6 is stripped from the tapered splined male pin 15, withdrawing the splined head shaft 30 downward into the spline pin shaft guide sleeve 8, to thus strip the formed end brush 6 from the splined pin 15. Cylinder 29 is then actuated to drive brush knock off hammer 34 into the formed end brush 6 held on top of splined pin shaft guide sleeve 8, the completed end brush is thus freed from the apparatus of manufacture. On retraction of the tapered splined male pin 15, the actuation of cylinder 17, stop plate 10 is extended in forward position by actuation of cylinder 11, to contact bottom shoulder of stop collar 9 to thus hold splined pin shaft guide sleeve 8 in position while withdrawing splined pin 15, containing end brush 6, into guide sleeve 8 to strip the end brush 6 from the splined pin.

Figure 10:
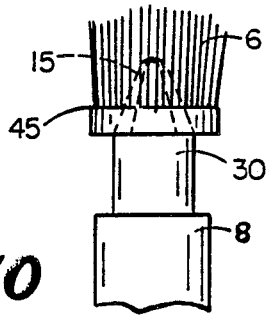
FIG. 10—Expanded elevation view of end brush attached to tapered splined male pin.

It is to be pointed out that as noted in FIG. 10, the end brush 45 is attached to splined pin 15. This attachment is due to the cooling of the fused fibers around the pin 15.

In this disclosure alternate means can be used in some segments of the apparatus. For example, a fluid powered cylinder can be used instead of the compression spring 31 to force the heated, tapered splined male pin 15 into the base of the fiber bundle held in fiber bundle adjustable aperture plate 2.

The tapered splined male pin 15 is forced by compression spring 31 into the fiber bundle base and makes entry due to the softening of thermoplastic fibers which are subsequently fused together, on cooling.

In the above description of the invention, "reciprocating" is to define movement as required in the operation of the apparatus, and includes the term "reciprocable".

Having disclosed my invention, I claim:

1. Apparatus for manufacture of end brush wherein the improvement comprises: a fiber feed guide eye for fiber skein feeding said fiber skein into an aperture of fiber bundle adjustable aperture plate and closing said aperture around said fiber bundle in said adjustable aperture plate, and means for heating a tapered splined male pin in contact with the bottom of said fiber bundle and means to push said heated tapered splined male pin into the bottom of said fiber bundle comprising a compression spring on a splined head shaft flanged base, and means to cool said tapered splined male pin, extending into said fiber bundle to solidify the melted fiber bundle, and opening said aperture to draw out the fiber bundle attached to said tapered splined pin, and a fluid power cylinder actuated fiber bundle cutter blade to cut said fiber bundle drawn out of said aperture, and said fiber bundle attached to said tapered splined pin withdrawn into a splined pin shaft guide sleeve to strip the so formed end brush from said tapered splined pin and means to drive said end brush off the top of said splined pin shaft guide sleeve, said means comprising a fluid power cylinder to actuate a brush knock off hammer.

2. Apparatus for manufacture of an end brush comprising:

a—a fiber hank feed trough and
b—a fiber feed guide eye and
c—an adjustable aperture in an aperture plate and
d—a tapered splined male pin mounted on a shaft and
e—said tapered splined male pin shaft mounted in a spline pin shaft guide sleeve and
f—an electric induction heater coil mounted around said tapered splined male pin and
g—a flanged base of said splined male pin shaft mounted on a compression spring and
h—said flanged base and said spring mounted in a housing and
i—said housing mounted on a connecting rod from a fluid drive cylinder and
j—a collar mount attached on said splined head shaft and said collar mount and splined head shaft reciprocating in a stop collar and
k—a stop plate to contact said stop collar and
l—a cold air duct aimed at said electric induction heater coil mounted around said splined pin and,
m—said collar mount top to contact an upper stop to set the upward movement of said spline head and shaft and
n—said splined male pin extends beyond a top rim of said spline shaft guide sleeve and
o—said housing for said compression spring and splined head shaft flanged base is attached to a connecting rod from a fluid drive cylinder for actuation upward and downward and
p—splined head shaft stop limits mounted above said stop collar and a lower stop rim below said stop collar and
q—said above and lower stops for said stop collar held in position by a reciprocating stop plate and stop limit and
r—a fiber bundle cutter blade actuated by a fluid power cylinder and
s—a brush knock off hammer actuated by a fluid power cylinder.

3. Apparatus for manufacture of an end brush wherein the improvement comprises:

a—a fiber feed guide eye for fiber skein feeding said fiber skein into an aperture of a fiber bundle adjustable aperture plate and
b—means for heating a tapered splined male pin in contact with the bottom of said fiber bundle and
c—means to push said heated tapered splined male pin into the bottom of said fiber bundle comprising a compression spring on the splined head shaft flanged base and
d—means to cool said tapered splined male pin, extending into said fiber bundle to solidify the melted fiber bundle, and
e—opening said aperture to draw out a fiber bundle attached to said tapered splined pin and
f—a fluid power cylinder actuated fiber bundle cutter blade to cut said fiber bundle drawn out of said aperture and
g—said fiber bundle attached to said tapered splined pin withdrawn into a splined pin shaft guide sleeve to strip the formed end brush from said tapered splined pin and
h—means to drive said end brush off the top of said splined pin shaft guide sleeve, said means comprising a fluid power cylinder to actuate a brush knock off hammer.

4. Apparatus for end brush manufacture of claim 3 wherein the improvement comprises:

means for heat fusing a base of a fiber bundle of thermoplastic fibers, said means consisting of electric induction heating of tapered splined male pin and means of forcing said induction heated tapered splined male pin into said base of fiber bundle by means of a compression spring, acting on a flanged base of said tapered splined male pin and air cooling said heated tapered splined male pin embedded in said base of said fiber bundle, to fuse the ends of said fiber bundle.

5. Apparatus for manufacture of end brush of claim 3 wherein the improvement comprises:

means for heating the tapered splined male pin comprising of electric induction heating consisting of a conduction coil surrounding said tapered splined male pin.

6. Apparatus for manufacture of end brush of claim 3 wherein the improvement comprises:

means for cooling the tapered splined male pin consisting of a cold air blast over said tapered splined male pin.

* * * * *